US010023933B2

(12) United States Patent
Tanaka et al.

(10) Patent No.: US 10,023,933 B2
(45) Date of Patent: Jul. 17, 2018

(54) GALVANNEALED STEEL SHEET AND METHOD FOR PRODUCING THE SAME

(71) Applicant: JFE STEEL CORPORATION, Tokyo (JP)

(72) Inventors: Minoru Tanaka, Fukuyama (JP); Yoshitsugu Suzuki, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 211 days.

(21) Appl. No.: 15/116,066

(22) PCT Filed: Jan. 30, 2015

(86) PCT No.: PCT/JP2015/000428

§ 371 (c)(1),
(2) Date: Aug. 2, 2016

(87) PCT Pub. No.: WO2015/115112

PCT Pub. Date: Aug. 6, 2015

(65) Prior Publication Data

US 2017/0166989 A1 Jun. 15, 2017

(30) Foreign Application Priority Data

Feb. 3, 2014 (JP) ..... 2014-018245

(51) Int. Cl.

| | |
|---|---|
| ***C22C 38/02*** | (2006.01) |
| ***C22C 38/04*** | (2006.01) |
| ***B32B 15/00*** | (2006.01) |
| ***C21D 9/46*** | (2006.01) |
| ***C22C 38/58*** | (2006.01) |
| ***C22C 38/54*** | (2006.01) |
| ***C22C 38/50*** | (2006.01) |
| ***C22C 38/48*** | (2006.01) |
| ***C22C 38/44*** | (2006.01) |
| ***C22C 38/42*** | (2006.01) |
| ***C22C 38/38*** | (2006.01) |
| ***C22C 38/34*** | (2006.01) |
| ***C22C 38/32*** | (2006.01) |
| ***C22C 38/28*** | (2006.01) |
| ***C22C 38/26*** | (2006.01) |
| ***C22C 38/22*** | (2006.01) |
| ***C22C 38/20*** | (2006.01) |
| ***C22C 38/06*** | (2006.01) |
| ***C22C 38/00*** | (2006.01) |
| ***C21D 8/02*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C21D 9/46* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C22C 38/34* (2013.01); *C22C 38/38* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C23C 2/06* (2013.01); *C23C 2/28* (2013.01); *C23C 2/40* (2013.01)

(58) Field of Classification Search

CPC ..... C22C 38/00; C22C 38/02; C22C 38/04; C22C 38/06; C21D 1/34; C23C 2/34; B32B 15/011; B32B 15/18

See application file for complete search history.

(56) References Cited

U.S. PATENT DOCUMENTS 4,351,854 A * 9/1982 Pelerin ..... C23C 2/003 118/429
2017/0314116 A1* 11/2017 Kawata ..... C21D 9/46

FOREIGN PATENT DOCUMENTS

| | | |
|---|---|---|
| CA | 2836118 A1 | 12/2012 |
| JP | 4202630 | 7/1992 |
| JP | 6306561 | 11/1994 |
| JP | 2007291498 | 11/2007 |
| JP | 2010116590 | 5/2010 |
| WO | 2013051238 | 3/2015 |
| WO | 2013157222 | 12/2015 |

OTHER PUBLICATIONS

International Search Report and Written Opinion for International Application No. PCT/JP2015/000428, dated Apr. 28, 2015, 4 pages.
Korean Office Action for Korean Application No. 2016-7024354, dated May 29, 2017, 5 pages.
Chinese Office Action for Chinese Application No. 201580006924.5, dated Dec. 27, 2017, 9 pages.

(Continued)

*Primary Examiner* — Mark Kopec
(74) *Attorney, Agent, or Firm* — RatnerPrestia

(57) ABSTRACT

A galvannealed steel sheet having a galvanized layer on a surface thereof is provided, having a composition which contains C: 0.10% to 0.35%, Si: 0.3% to 3.0%, Mn: 0.5% to 3.0%, P: 0.001% to 0.10%, Al: 0.01% to 3.00%, and S: 0.200% or less on a mass basis, the remainder being Fe and incidental impurities. The steel sheet has a $SiC/SiO_2$ ratio of more than 0.20, the $SiC/SiO_2$ ratio being a ratio of SiC amount to $SiO_2$ amount at a depth of 1 μm or less in the steel sheet from an interface between the steel sheet and the galvanized layer, and Fe in the galvanized layer constitutes 8% to 13% by mass.

5 Claims, No Drawings

(56) References Cited

OTHER PUBLICATIONS

Japanese Notice of Allowance with partial English language translation for Application No. JP 2014018245, dated Oct. 20, 2015, 4 pages.
Extended European Search Report for Application No. 15743046.3, dated Jan. 31, 2017, 9 pages.
Rauf Razzaq et al.; Coke Oven Gas; Availability, Properties, Purification, and Utilization in China; Fuel, vol. 113, pp. 287-299; XP 28698597; Jun. 2013, 14 pages.

* cited by examiner

GALVANNEALED STEEL SHEET AND METHOD FOR PRODUCING THE SAME

CROSS-REFERENCE TO RELATED APPLICATIONS

This is the U.S. National Phase application of PCT International Application No. PCT/JP2015/000428, filed Jan. 30, 2015, and claims priority to Japanese Patent Application No. 2014-018245, filed Feb. 3, 2014, the disclosures of each of these applications being incorporated herein by reference in their entireties for all purposes.

FIELD OF THE INVENTION

The present invention relates to a galvannealed steel sheet having good adhesion to a coating and a method for producing the galvannealed steel sheet.

BACKGROUND OF THE INVENTION

In recent years, surface-treated steel sheets produced by rustproofing steel sheet materials, particularly, excellently rustproof hot-dip galvanized steel sheets and galvannealed steel sheets, have been used in the fields of automobiles, household electrical appliances, and construction materials.

In general, hot-dip galvanized steel sheets are produced by the following method. First, a slab is subjected to hot rolling, cold rolling, and heat treatment to form a thin steel sheet. The surface of the steel sheet is washed by means of degreasing and/or pickling in a pretreatment step. Alternatively, without the pretreatment step, oils on the surface of the steel sheet are burned in a preheating furnace. The steel sheet is then heated in a nonoxidizing or reducing atmosphere for recrystallization annealing. The steel sheet is then cooled in a nonoxidizing or reducing atmosphere to a temperature suitable for coating and is immersed in a hot-dip galvanizing bath without exposed to the air. The hot-dip galvanizing bath contains a minute amount of Al (approximately 0.1% to 0.2% by mass). Thus, the surface of the steel sheet is coated and becomes a hot-dip galvanized steel sheet. Galvannealed steel sheets are produced by heat-treating hot-dip galvanized steel sheets in an alloying furnace.

In recent years, in the automotive field, steel sheet materials have had higher performance and reduced weight. Increasing strength of steel sheets in order to compensate for strength reduction resulting from weight reduction of steel sheet materials is realized by the addition of solid-solution strengthening elements, such as Si and Mn. In particular, Si can advantageously increasing strength of steel without decreasing ductility. Thus, Si-containing steel sheets are promising high-strength steel sheets. However, the following problems occur in the production of hot-dip galvanized steel sheets and galvannealed steel sheets, when high-strength steel sheets containing large amounts of Si are used as base material.

As described above, hot-dip galvanized steel sheets are annealed in a reducing atmosphere before coating. However, because of its high affinity for oxygen, Si in steel is selectively oxidized even in a reducing atmosphere and forms oxides on the surface of steel sheets. These oxides decrease the wettability of the surface of the steel sheets and form uncoated areas in a coating process. Even when uncoated areas are not formed, these oxides decrease the adhesiveness of the coating.

Several techniques are disclosed in order to address these problems. Patent Literature 1 discloses a technique for improving the wettability of a steel sheet by molten zinc by forming iron oxide on the surface of the steel sheet in an oxidizing atmosphere and then forming a reduced iron layer on the surface of the steel sheet by reduction annealing.

Patent Literature 2 discloses a technique for ensuring high coating quality by controlling the atmosphere, such as the oxygen concentration, in a preheating operation.

Patent Literature 3 discloses a technique of producing a hot-dip galvanized steel sheet that has no uncoated area and has good appearance by dividing the heating zone into three zones A to C and appropriately controlling the temperature and oxygen concentration of each of the heating zones to reduce the occurrence of indentation flaws.

CITATION LIST

Patent Literature

PTL 1: Japanese Unexamined Patent Application Publication No. 4-202630

PTL 2: Japanese Unexamined Patent Application Publication No. 6-306561

PTL 3: Japanese Unexamined Patent Application Publication No. 2007-291498

SUMMARY OF THE INVENTION

In the methods in which hot-dip galvanizing is performed on high-Si-content steel using oxidation-reduction techniques as described in Patent Literature 1 and Patent Literature 2, although the formation of uncoated areas is suppressed, there is a problem of occurrence of indentation flaws, which are defects characteristic of the oxidation-reduction techniques.

A method for controlling the temperature and oxygen concentration of A to C heating zones as described in Patent Literature 3 can be used to produce hot-dip galvanized steel sheets free of surface defects, such as uncoated areas and indentation flaws. However, a high concentration of Si dissolved as solid solute in a steel sheet (or Si activity) retards an alloying reaction of Fe and Zn, thus there is a problem of resulting in a higher alloying temperature. At a high alloying temperature, a thick Γ layer having poor adhesion to a coating is formed and significantly decreases the adhesiveness of a coated layer. A high alloying temperature also results in degraded mechanical characteristics of the steel sheet due to decomposition of a ductile retained austenite phase. On the other hand, a low alloying temperature results in a low concentration of Fe in the Zn coating and a defective appearance, although adhesion to the coating is improved. A low Fe concentration results in the formation of a thick ζ layer having a high friction coefficient on the coated surface and thereby impairs the advantageous sliding characteristics of alloyed hot dip galvanizing.

The present invention is made in view of such situations and it is an object of the present invention to provide a galvannealed steel sheet having good adhesion to a coating and a method for producing such a galvannealed steel sheet.

In order to solve these problems, the present inventors have paid attention to and intensively studied the microstructure of a steel sheet surface layer having a thickness of 1 μm in which an alloying reaction occurs after Zn coating. As a result, the present inventors have found that adhesion to a galvanized layer on a steel sheet can be improved by controlling the $SiC/SiO_2$ ratio, that is, a ratio of amount of SiC to that of $SiO_2$ at a depth of 1 μm or less in the steel sheet from the interface between the steel sheet and the galvanized layer.

The present invention is based on the finding and includes the following:

[1] A galvannealed steel sheet having a galvanized layer on a surface thereof, having a composition containing on a mass basis: C: 0.10% to 0.35%, Si: 0.3% to 3.0%, Mn: 0.5% to 3.0%, P: 0.001% to 0.10%, Al: 0.01% to 3.00%, and S: 0.200% or less, a remainder being Fe and incidental impurities, wherein the steel sheet has a $SiC/SiO_2$ ratio of more than 0.20, the $SiC/SiO_2$ ratio being a ratio of SiC amount to $SiO_2$ amount at a depth of 1 μm or less in the steel sheet from an interface between the steel sheet and the galvanized layer, and Fe in the galvanized layer constitutes 8% to 13% by mass.

[2] The galvannealed steel sheet according to [1], wherein a retained austenite phase constitutes 0.2% or more by area of the steel sheet at a depth of 1 μm or less in the steel sheet from the interface between the steel sheet and the galvanized layer.

[3] The galvannealed steel sheet according to [1] or [2], the composition further containing one or two selected from Mo: 0.01% to 1.00% and Cr: 0.01% to 1.00% on a mass basis.

[4] The galvannealed steel sheet according to any one of [1] to [3], the composition further containing one or two or more selected from Nb: 0.005% to 0.20%, Ti: 0.005% to 0.20%, Cu: 0.01% to 0.50%, Ni: 0.01% to 1.00%, and B: 0.0005% to 0.010% on a mass basis.

[5] A method for producing a galvannealed steel sheet, involving: hot rolling and then cold rolling a steel having the composition according to any one of [1], [3], and [4]; then heating the steel in a direct heating furnace equipped with a direct fired burner to a final surface temperature in the range of 550° C. to 750° C. by burning a combustible gas and a combustion-supporting gas, the combustible gas having a CO concentration in the range of 5% to 10% by volume, a $CH_4$ concentration in the range of 20% to 30% by volume, and a $H_2$ concentration in the range of 50% to 60% by volume, a remainder of the combustible gas being $N_2$ and incidental impurities, the combustion-supporting gas having an $O_2$ concentration in the range of 20% to 40% by volume, a remainder of the combustion-supporting gas being $N_2$ and incidental impurities; then heating the steel at a soaking temperature in the range of 630° C. to 850° C. in an atmosphere having a $H_2$ concentration in the range of 5% to 40% by volume and a $H_2O$ concentration in the range of 0.01% to 0.40% by volume, a remainder of the atmosphere being $N_2$ and incidental impurities; and cooling the steel at an average cooling rate of 15° C./s or more, then subjecting the steel to hot-dip galvanizing treatment, and subjecting the steel to alloying treatment at a temperature of 560° C. or less.

The present invention provides a galvannealed steel sheet having good adhesion to a coating. The present invention is particularly effective in the case where steel sheets containing 0.3% or more Si or high-Si-content steel sheets are used as base materials, although hot-dip galvanizing treatment and alloying are generally believed to be difficult in such a case. Thus, the present invention is useful as a method for achieving high productivity and coating quality in the production of high-Si-content hot-dip galvanized steel sheets.

DETAILED DESCRIPTION OF EMBODIMENTS OF THE INVENTION

Embodiments of the present invention will be specifically described below.

The composition of steel sheets for use in embodiments of the present invention will be described below. Unless otherwise specified, the percentages of the components are on a mass basis.

C: 0.10% to 0.35%

C is important in the present invention. A C content of 0.10% or more is required for the effect of significantly decreasing the amount of Si dissolved as solid solute in the surface of a steel sheet due to C in the steel. However, a C content of more than 0.35% results in poor workability. Thus, the C content ranges from 0.10% to 0.35%. Preferably, the C content is 0.20% or less in terms of weldability.

Si: 0.3% to 3.0%

Si is the most important element to improve the mechanical characteristics of steel sheets. The Si content should be 0.3% or more. However, a Si content of more than 3.0% results in concentrated Si in the surface of a steel sheet in an annealing process, and the concentrated Si acts as a starting point of an uncoated area. This significantly impairs the surface appearance after Zn coating. Thus, the Si content ranges from 0.3% to 3.0%.

Mn: 0.5% to 3.0%

Mn is a solid-solution strengthening element and is effective in increasing strength of steel sheets. The Mn content should be 0.5% or more. However, a Mn content of more than 3.0% results in poor weldability and adhesion to a coating. A Mn content of more than 3.0% also results in a difficulty for ensuring strength ductility balance. Thus, the Mn content ranges from 0.5% to 3.0%.

P: 0.001% to 0.10%

The P content is 0.001% or more in order to retard the precipitation of cementite and to retard phase transformation. However, a P content of more than 0.10% results in poor weldability and adhesion to a coating. Furthermore, this retards alloying, which increases the alloying temperature, and decreases ductility. Thus, the P content ranges from 0.001% to 0.10%.

Al: 0.01% to 3.00%

Al and Si are elements contained complementary to each other. Al is an inevitably introduced in the steel production process, and a lower limit of the Al content is 0.01%. However, an Al content of more than 3.00% makes it difficult to suppress the formation of $Al_2O_3$ and results in poor adhesiveness of a coated layer. Thus, the Al content ranges from 0.01% to 3.00%.

S: 0.200% or less

S is an element that is inevitably contained in the steel production process. However, a high S content results in poor weldability. Thus, the S content is 0.200% or less.

The remainder is Fe and incidental impurities.

Although the composition of these components can provide the advantageous effect of the present invention, the following elements may be contained in order to improve productivity or material properties.

One or two selected from Mo: 0.01% to 1.00% and Cr: 0.01% to 1.00%

Mo: 0.01% to 1.00%

Mo is an element that controls the strength ductility balance. The Mo content may be 0.01% or more. Mo is effective in promoting internal oxidation of Si and Al and in suppressing surface enrichment of Si and Al. However, a Mo content of more than 1.00% may result in increased costs. Thus, when Mo is contained, the Mo content ranges from 0.01% to 1.00%.

Cr: 0.01% to 1.00%

Cr is an element that controls the strength ductility balance. The Cr content may be 0.01% or more. Like Mo, Cr is effective in promoting internal oxidation of Si and Al and in suppressing surface enrichment of Si and Al. However, a Cr content of more than 1.00% may result in poor adhesion to a coating and weldability due to surface enrichment of Cr. Thus, when Cr is contained, the Cr content ranges from 0.01% to 1.00%.

One or two or more selected from Nb: 0.005% to 0.20%, Ti: 0.005% to 0.20%, Cu: 0.01% to 0.50%, Ni: 0.01% to 1.00%, and B: 0.0005% to 0.010%

Nb: 0.005% to 0.20%

Nb is an element that controls the strength ductility balance. The Nb content may be 0.005% or more. However, a Nb content of more than 0.20% may result in increased costs. Thus, when Nb is contained, the Nb content ranges from 0.005% to 0.20%.

Ti: 0.005% to 0.20%

Ti is an element that controls the strength ductility balance. The Ti content may be 0.005% or more. However, a Ti content of more than 0.20% may result in poor adhesion to a coating. Thus, when Ti is contained, the Ti content ranges from 0.005% to 0.20%.

Cu: 0.01% to 0.50%

Cu is an element that promotes the formation of a retained austenite phase. The Cu content may be 0.01% or more. However, a Cu content of more than 0.50% may result in increased costs. Thus, when Cu is contained, the Cu content ranges from 0.01% to 0.50%.

Ni: 0.01% to 1.00%

Ni is an element that promotes the formation of a retained austenite phase. The Ni content may be 0.01% or more. However, a Ni content of more than 1.00% may result in increased costs. Thus, when Ni is contained, the Ni content ranges from 0.01% to 1.00%.

B: 0.0005% to 0.010%

B is an element that promotes the formation of a retained austenite phase. The B content may be 0.0005% or more. However, a B content of more than 0.010% may result in poor adhesion to a coating. Thus, when B is contained, the B content ranges from 0.0005% to 0.010%.

A microstructure of a steel sheet surface layer having a thickness of 1 μm or less is most important in the present invention and will be described below.

A steel sheet according to an aspect of the present invention has a $SiC/SiO_2$ ratio of more than 0.20 at a depth of 1 μm or less in the steel sheet from an interface between the steel sheet and a galvanized layer. SiC and $SiO_2$ can be identified by EDX composition analysis of a cross-sectional structure with respect to Si, C, and O in SEM observation. SiC and $SiO_2$ can also be identified by examining the chemical bonding state of Si by XPS. SPMA element mapping or TEM electron diffraction images may also be used for the identification. In the present invention, the $SiC/SiO_2$ ratio is determined from the ratio of the integrated value of SiC peak to that of $SiO_2$ peak in the XPS analysis of a surface of a steel sheet from which a Zn coating is removed. The $SiC/SiO_2$ ratio in the present invention can be controlled by changing the heat-treatment conditions, the C content of steel, and the Si content of the steel.

Preferably, a retained austenite phase constitutes 0.2% or more by area of the steel sheet at a depth of 1 μm or less in the steel sheet from the interface between the steel sheet and the galvanized layer. The retained austenite phase can be analyzed by an example method described later.

In a method of hot-dip galvanizing high-Si-content steel using a known oxidation-reduction technique, an internal oxide of $SiO_2$ is formed in the steel sheet. Formation of such an oxide is effective to decrease the concentration of Si in the steel in the steel sheet surface layer. However, in a high-Si-content steel sheet having a Si content of more than 0.3%, the formation of such an internal oxide alone cannot sufficiently decrease the concentration of Si in the steel sheet surface layer, and dissolved Si inhibits an alloying reaction and increases the alloying temperature, thereby decreasing adhesion to the coating.

The present inventors have found that even at a Si content of more than 0.3%, a sufficient amount of C in the steel can decrease the concentration of Si dissolved in the steel sheet surface layer, lower the alloying temperature, and improve adhesion to the coating. This is due to the following reasons.

First, C in steel forms SiC according to the following formula (1).

$$\underline{Si}+\underline{C}\rightarrow SiC \quad (1)$$

An internal oxide $SiO_2$ previously formed is reduced by C in the steel according to the following formula (2). An increase in oxygen potential in the steel and a decrease in $SiO_2$ concentration occur simultaneously. Thus, an internal oxidation reaction of Si in the steel is promoted according to the following formula (3).

$$SiO_2+C\rightarrow SiC+O_2 \quad (2)$$

$$\underline{Si}+O_2\rightarrow SiO_2 \quad (3)$$

Consequently, the concentration of Si in the surface of the steel sheet decreases. This results in a lower alloying temperature and improved adhesion to the coating.

Thus, the present invention has a characteristic that a sufficient amount of C in steel decreases the concentration of Si dissolved in a steel sheet surface layer, lowers the alloying temperature, and thereby improves adhesion to a coating. More specifically, the formation of SiC in addition to the formation of a $SiO_2$ internal oxide decreases the concentration of Si dissolved in the surface of a steel sheet to the level at which low-temperature alloying may proceed.

The present invention further has a characteristic that the ratio of SiC amount to $SiO_2$ amount at a depth of 1 μm or less in the steel sheet from the interface between the steel sheet and a galvanized layer is used as a index of the decrease in the concentration of Si dissolved in the surface of the steel sheet due to the formation of SiC, the $SiC/SiO_2$ ratio being more than 0.20. The advantages of the present invention can be achieved by controlling the $SiC/SiO_2$ ratio at a depth of 1 μm or less in the steel sheet from the interface. A $SiC/SiO_2$ ratio of 0.20 or less results in insufficient formation of SiC and an insufficient effect of decreasing the alloying temperature. A $SiC/SiO_2$ ratio of more than 0.60 may result in excessively precipitated carbide, which can act as a starting point of cracks in bending. Thus, the upper limit of the $SiC/SiO_2$ ratio is preferably 0.60.

A retained austenite phase ensures workability of a surface of a steel sheet due to deformation induced transformation. Thus, the retained austenite phase preferably constitutes 0.2% or more by area of a steel sheet at a depth of 1 μm or less in the steel sheet from the interface between the steel sheet and a galvanized layer.

The ratio of SiC amount to SiO2 amount at a depth of 1 μm or less in the steel sheet from the interface between the steel sheet and a galvanized layer can be controlled not only by changing the C content of the steel but also by the heat-treatment conditions. In the present invention, before hot-dip galvanizing treatment, a cold-rolled steel sheet is heated in a direct heating furnace and then in a reducing atmosphere. In the direct heating furnace, the surface of the steel sheet is heated with a direct fired burner. A high oxygen potential in the combustion atmosphere results in internal oxidation of Si in the steel sheet simultaneously with oxidation of the surface of the steel sheet due to heating with the direct fired burner, thus resulting in the formation of $SiO_2$. At the same time, if the carbon potential in the combustion atmosphere is high, carbonization of Si in the steel proceeds and SiC is formed. In reduction annealing, $SiO_2$ is reduced by C in steel and forms SiC. The details are described later.

The Fe content of the galvanized layer ranges from 8% to 13% by mass. An Fe content of less than 8% by mass results in degraded sliding characteristics. On the other hand, an Fe content of more than 13% by mass results in low powdering resistance.

A method for producing a galvannealed steel sheet having good adhesion to a coating according to aspects of the present invention will be described below.

A galvannealed steel sheet according to the present invention can be produced by hot rolling and then cold rolling a steel having the composition described above to form a steel sheet, then subjecting the steel sheet to annealing and hot-dip galvanizing treatment in continuous hot-dip galvanizing equipment including a direct heating furnace equipped with a direct fired burner, and then subjecting the steel sheet to alloying treatment. The annealing in the continuous hot-dip galvanizing equipment including the direct heating furnace equipped with the direct fired burner involves heating the steel sheet to a final surface temperature in the range of 550° C. to 750° C. by burning a combustible gas and a combustion-supporting gas, and then heating the steel sheet at a soaking temperature in the range of 630° C. to 850° C. in an atmosphere having a $H_2$ concentration in the range of 5% to 40% by volume and a $H_2O$ concentration in the range of 0.01% to 0.40% by volume, the remainder of the atmosphere being $N_2$ and incidental impurities. The combustible gas has a CO concentration in the range of 5% to 10% by volume, a $CH_4$ concentration in the range of 20% to 30% by volume, and a $H_2$ concentration in the range of 50% to 60% by volume, the remainder being $N_2$ and incidental impurities. The combustion-supporting gas has an $O_2$ concentration in the range of 20% to 40% by volume, the remainder being $N_2$ and incidental impurities. The steel sheet is then cooled at an average cooling rate of 15° C./s or more, is then subjected to hot-dip galvanizing treatment, and is subjected to alloying treatment at a temperature of 560° C. or less.

Hot Rolling

General conditions may be used.

Pickling

The hot rolling is preferably followed by pickling treatment. Mill scale formed on the surface is removed in a pickling process before cold rolling. The pickling conditions are not particularly limited.

Cold Rolling

The cold rolling is preferably performed at a rolling reduction in the range of 30% to 90%. A rolling reduction of less than 30% often results in poor mechanical characteristics due to slow recrystallization. On the other hand, a rolling reduction of more than 90% results in not only increased rolling costs but also poor coating characteristics due to increased surface enrichment during annealing.

The annealing conditions will be described below. The annealing conditions are important in the present invention. Under the annealing (heat treatment) conditions described herein, SiC and $SiO_2$ can be formed at a $SiC/SiO_2$ ratio of more than 0.20 in the steel sheet at a depth of 1 μm or less from the interface between the steel sheet and the galvanized layer.

First, a steel sheet is heated to a final surface temperature in the range of 550° C. to 750° C. by burning a combustible gas and a combustion-supporting gas. The combustible gas has a CO concentration in the range of 5% to 10% by volume, a $CH_4$ concentration in the range of 20% to 30% by volume, and a $H_2$ concentration in the range of 50% to 60% by volume, the remainder being $N_2$ and incidental impurities. The combustion-supporting gas has an $O_2$ concentration in the range of 20% to 40% by volume, the remainder being $N_2$ and incidental impurities.

Combustible gas: a CO concentration in the range of 5% to 10% by volume, a $CH_4$ concentration in the range of 20% to 30% by volume, and a $H_2$ concentration in the range of 50% to 60% by volume, the remainder being $N_2$ and incidental impurities CO Concentration: 5% to 10% by Volume A CO concentration of less than 5% by volume results in a low carbon potential in the atmosphere and suppressed formation of SiC from CO gas. A CO concentration of more than 10% by volume results in a higher reducing power and suppressed formation of $SiO_2$. Thus, the concentration of CO in the combustible gas for direct heating ranges from 5% to 10% by volume.

$CH_4$ Concentration: 20% to 30% by Volume

A $CH_4$ concentration of less than 20% by volume results in a low carbon potential in the atmosphere and suppressed formation of SiC from $CH_4$ gas. A $CH_4$ concentration of more than 30% by volume results in a higher reducing power and suppressed formation of $SiO_2$. Thus, the concentration of $CH_4$ in the combustible gas for direct heating ranges from 20% to 30% by volume.

$H_2$ Concentration: 50% to 60% by Volume

A $H_2$ concentration of less than 50% by volume results in a smaller amount of heat of the combustible gas and low combustion efficiency. A $H_2$ concentration of more than 60% by volume results in a higher reducing power and suppressed formation of $SiO_2$. Thus, the concentration of $H_2$ in the combustible gas for direct heating ranges from 50% to 60% by volume.

The remainder is $N_2$ and incidental impurities.

Combustion-Supporting Gas: An $O_2$ Concentration in the Range of 20% to 40% by Volume, the Remainder being $N_2$ and Incidental Impurities $O_2$ Concentration: 20% to 40% by Volume An $O_2$ concentration of less than 20% by volume results in a low oxygen potential in the atmosphere and an amount of $O_2$ insufficient to form Fe oxide necessary to suppress the formation of uncoated areas. An $O_2$ concentration of more than 40% by volume results in a high oxidizing power and causes an operation trouble due to excessive oxidation, such as pickup in the furnace. Thus, the concentration of $O_2$ in the combustion-supporting gas for direct heating ranges from 20% to 40% by volume.

The remainder is $N_2$ and incidental impurities.

Final surface temperature of steel sheet: 550° C. to 750° C.

When the final surface temperature of the steel sheet is less than 550° C., this results in an amount of $O_2$ insufficient to form Fe oxide necessary to suppress the formation of uncoated areas. A final surface temperature of the steel sheet of more than 750° C. results in an excessive amount of oxides and causes defects called indentation flaws on the surface. Thus, the final surface temperature of the steel sheet in direct heating ranges from 550° C. to 750° C.

The steel sheet is then subjected to heat treatment at a soaking temperature in the range of 630° C. to 850° C. in an atmosphere having a $H_2$ concentration in the range of 5% to 40% and a $H_2O$ concentration in the range of 0.01% to 0.40% by volume, the remainder of the atmosphere being $N_2$ and incidental impurities.

$H_2$ Concentration: 5% to 40% by Volume

A $H_2$ concentration of less than 5% by volume results in a high oxygen potential in the atmosphere and insufficient reduction of Fe oxide formed on the surface of the steel sheet in direct heating. A $H_2$ concentration of more than 40% by volume results in increased operating costs. Thus, the concentration of $H_2$ in the annealing atmosphere ranges from 5% to 40% by volume.

$H_2O$ Concentration: 0.01% to 0.40% by Volume

It is known that $H_2O$ in the annealing atmosphere promotes internal oxidation into $SiO_2$. However, a $H_2O$ concentration of less than 0.01% by volume results in insufficient promotion of internal oxidation of Si. A $H_2O$ concentration of more than 0.40% by volume results in a high oxygen potential in the atmosphere and insufficient reduction of Fe oxide formed on the surface of the steel sheet in direct heating. Thus, the concentration of $H_2O$ in the annealing atmosphere ranges from 0.01% to 0.40% by volume.

Soaking temperature: 630° C. to 850° C.

A soaking temperature of less than 630° C. results in an insufficient decrease in the amount of dissolved Si because of a slow internal oxidation reaction and carbonization reaction of Si in the surface layer. A soaking temperature of more than 850° C. results in poor mechanical characteristics, such as low toughness, because of coarsening of austenite and coarsening of the constituent phase after annealing. Thus, the soaking temperature ranges from 630° C. to 850° C.

The steel sheet is then cooled at an average cooling rate of 15° C./s or more, is then subjected to hot-dip galvanizing treatment, and is subjected to alloying treatment at a temperature of 560° C. or less. In the hot-dip galvanizing treatment, the steel sheet is preferably immersed in a Zn bath having an Al concentration in the range of 0.10% to 0.20% by mass and a bath temperature in the range of 440° C. to 500° C.

Cooling Rate: 15° C./s or More on Average

A cooling rate of less than 15° C./s results in the formation of a large amount of ferrite in a cooling process and a decrease in the formation of a retained austenite phase, which ensures workability of the steel sheet. Thus, the cooling rate after the heat treatment is 15° C./s or more on average. The cooling stop temperature preferably ranges from 200° C. to 550° C.

Hot-Dip Galvanizing Treatment

The concentration of Al in the Zn bath preferably ranges from 0.10% to 0.20% by mass. An Al concentration of less than 0.10% by mass may result in poor adhesion to the coating because a hard and brittle Fe—Zn alloy layer is formed at the interface between the galvanized layer and the steel sheet in a coating process. On the other hand, an Al concentration of more than 0.20% by mass may result in poor weldability because a thick Fe—Al alloy layer is formed at the interface between the galvanized layer and ferrite immediately after immersion in the bath. The Zn bath temperature is preferably 460° C. or more and less than 500° C. A Zn bath temperature of 460° C. or less may result in a slow alloying reaction. On the other hand, The Zn bath temperature of 500° C. or more may result in poor coating characteristics because a thick, hard and brittle Fe—Zn alloy layer is formed at the coated layer/ferrite interface. The coating weight is preferably, but not limited to, 10 g/m$^2$ or more in terms of corrosion resistance and the controllability of coating weight, and 120 g/m$^2$ or less in terms of workability and economics.

Alloying Temperature: 560° C. or Less

An alloying temperature of more than 560° C. results in poor adhesion to the coating because a thick, hard and brittle Fe—Zn alloy layer is formed at the interface between the coated layer and the steel sheet. This also results in poor workability of the steel sheet because a retained austenite phase, which contributes to ductility, decomposes. Thus, the alloying temperature is 560° C. or less.

EXAMPLES

Example 1

A slab having a steel composition listed in Table 1 was heated in a heating furnace at 1260° C. for 60 minutes, was hot-rolled to 2.8 mm, and was coiled at 540° C. The steel sheet was then pickled to remove mill scale and was cold-rolled to 1.4 mm at a rolling reduction of 50%. The steel sheet was then subjected to heat treatment (annealing) under the conditions listed in Table 2 in a CGL having a direct heating (DFF) type heating zone. Subsequently, the steel sheet was immersed in a Zn bath containing Al at 460° C. for hot-dip galvanizing treatment and was subjected to alloying treatment to produce a galvannealed steel sheet. The concentration of Al in the bath ranged from 0.10% to 0.20% by mass, and the coating weight was adjusted to be 45 g/m$^2$ by gas wiping.

The Fe % of the coated layer, the $SiC/SiO_2$ ratio, the percentage of retained austenite, surface appearance, and adhesion to the coating in the galvannealed steel sheet obtained above were estimated as described below.

Fe % of Coated Layer

The steel sheet was immersed in a mixed solution of 195 cc of an aqueous solution of 20% by mass NaOH and 10% by mass triethanolamine and 7 cc of a 35% by mass hydrogen peroxide aqueous solution to dissolve the coated layer. The elements in the resulting solution were determined by an ICP method. Thus, the Fe % of the coated layer was determined.

$SiC/SiO_2$ Ratio (Mass Ratio)

After the galvanized layer was removed, the $SiC/SiO_2$ ratio was determined from the integrated values of SiC and $SiO_2$ peaks in the XPS analysis of the surface of the steel sheet from which the Zn coating was removed. A monochrome AlKα line was used as an X-ray source. The voltage was 12 kV, and the electric current was 7 mA.

Percentage of Retained Austenite

The percentage of retained austenite was determined by measuring the integrated intensities for (200), (220), and (311) planes of fcc iron and for (200), (211), and (220) planes of bcc iron with an X-ray diffractometer using a MoKα line.

Surface Appearance

A 300 mm×300 mm area was visually inspected and the surface appearance was rated according to the following criteria:

Circle: No uncoated area, no indentation flaw, and no uneven alloying

Filled triangle: Slight uneven alloying

Triangle: A few uncoated areas or indentation flaws

Cross: Uncoated areas, indentation flaws, or uneven alloying

Adhesion to Coating

A cellophane adhesive tape was applied to a coated surface. The surface with the tape was bent 90° C. and bent back. Another cellophane adhesive tape having a width of 24 mm was applied to the inside of the processed portion (compressed side) parallel to the bent portion and was removed. The amount of peeled coating deposited on a portion of the cellophane adhesive tape having a length of 40 mm was measured as a Zn count by a fluorescent X-ray method and was converted into the amount of peeled coating per unit length (1 m), which was evaluated according to the following criteria. The mask diameter was 30 mm, the accelerating voltage and accelerating current of fluorescent X-rays were 50 kV and 50 mA respectively, and the measurement time was 20 seconds.

Double circle: Zn count of less than 3000

Circle: Zn count of 3000 or more and less than 5000

Triangle: Zn count of 5000 or more and less than 10000

Cross: Zn count of 10000 or more

Table 2 shows the results.

TABLE 1

| Steel | Composition of samples/mass % | | | | | | | | | | | | | |
|---|---|---|---|---|---|---|---|---|---|---|---|---|---|---|
| type | C | Si | Mn | P | Al | S | Mo | Cr | Nb | Ti | Cu | Ni | B | Remarks |
| A | 0.21 | 1.0 | 0.8 | 0.02 | 1.20 | 0.010 | — | — | — | — | — | — | — | Within scope of invention |
| B | 0.12 | 0.5 | 1.1 | 0.03 | 1.10 | 0.010 | — | — | — | — | — | — | — | Within scope of invention |
| C | 0.25 | 2.2 | 1.2 | 0.05 | 1.50 | 0.002 | 0.06 | — | — | — | — | — | — | Within scope of invention |
| D | 0.30 | 0.5 | 2.0 | 0.01 | 0.80 | 0.001 | — | 0.10 | — | — | — | 0.10 | — | Within scope of invention |
| E | 0.20 | 0.9 | 1.6 | 0.01 | 0.03 | 0.010 | 0.10 | 0.20 | — | — | — | — | — | Within scope of invention |
| F | 0.16 | 1.4 | 0.8 | 0.03 | 0.02 | 0.003 | — | 0.25 | 0.01 | — | — | — | 0.002 | Within scope of invention |
| G | 0.13 | 2.1 | 1.5 | 0.02 | 0.10 | 0.001 | 0.06 | 0.07 | — | 0.05 | — | — | — | Within scope of invention |
| H | 0.11 | 0.3 | 2.1 | 0.01 | 0.20 | 0.001 | 0.05 | — | — | — | — | — | 0.002 | Within scope of invention |
| I | 0.18 | 2.6 | 1.8 | 0.01 | 0.25 | 0.002 | — | 0.06 | 0.08 | 0.06 | 0.01 | 0.02 | — | Within scope of invention |
| J | 0.23 | 1.1 | 0.7 | 0.04 | 0.50 | 0.001 | 0.06 | 0.20 | 0.10 | 0.08 | — | — | — | Within scope of invention |
| K | 0.38 | 1.6 | 1.2 | 0.03 | 1.20 | 0.300 | — | 0.02 | — | 0.10 | 0.02 | 0.20 | — | Outside scope of invention |
| L | 0.15 | 0.1 | 1.1 | 0.01 | 0.60 | 0.001 | 0.03 | 0.05 | 0.04 | — | 0.01 | — | — | Outside scope of invention |
| M | 0.05 | 1.1 | 3.3 | 0.01 | 0.75 | 0.020 | 0.04 | 0.09 | 0.06 | — | — | — | 0.001 | Outside scope of invention |
| N | 0.43 | 3.1 | 1.9 | 0.02 | 0.03 | 0.020 | — | 0.06 | — | 0.02 | — | 0.08 | — | Outside scope of invention |
| O | 0.34 | 4.0 | 0.1 | 0.03 | 0.10 | 0.001 | 0.08 | — | 0.07 | 0.07 | 0.03 | 0.06 | — | Outside scope of invention |
| P | 0.03 | 2.0 | 2.0 | 0.01 | 3.20 | 0.020 | 0.45 | 3.50 | — | 0.12 | — | — | 0.001 | Outside scope of invention |
| Q | 0.05 | 0.8 | 2.3 | 0.02 | 0.50 | 0.010 | 1.55 | 0.80 | 0.04 | — | 0.05 | 0.04 | — | Outside scope of invention |
| R | 0.01 | 0.7 | 1.1 | 0.15 | 0.60 | 0.005 | 0.35 | 1.50 | 0.04 | 0.10 | — | 0.06 | 0.001 | Outside scope of invention |
| S | 0.03 | 1.3 | 1.5 | 0.02 | 1.20 | 0.030 | 0.03 | 0.03 | 0.50 | 0.15 | 0.03 | — | — | Outside scope of invention |
| T | 0.12 | 3.2 | 1.6 | 0.01 | 1.40 | 0.003 | 0.02 | 0.50 | 0.10 | 0.03 | — | 0.10 | 0.02 | Outside scope of invention |
| U | 0.50 | 1.5 | 0.8 | 0.01 | 1.10 | 0.001 | 0.15 | 0.15 | 0.01 | 0.40 | 0.10 | 0.15 | — | Outside scope of invention |
| V | 0.11 | 0.1 | 1.4 | 0.02 | 2.10 | 0.001 | 0.01 | 0.21 | — | 0.02 | 1.00 | — | — | Outside scope of invention |
| W | 0.15 | 1.6 | 0.9 | 0.01 | 3.50 | 0.002 | 0.03 | 0.35 | 0.08 | — | — | 2.00 | — | Outside scope of invention |

TABLE 2

| Steel | | Direct heating | | | | | Soaking temperature/° C. | | | |
|---|---|---|---|---|---|---|---|---|---|---|
| | | | Combustible gas | | | Combustion- | | | | |
| sheet No. | Steel type | Heating temperature/° C. | CO/ vol % | $CH_4$/ vol % | $H_2$/ vol % | supporting gas $O_2$/vol % | Soaking temperature/° C. | $H_2$/vol % | $H_2O$/vol % | Cooling rate/° C. $s^{-1}$ |
| 1 | A | 720 | 7 | 21 | 56 | 20 | 650 | 10 | 0.06 | 18 |
| 2 | A | 690 | 8 | 26 | 59 | 23 | 680 | 12 | 0.06 | 20 |
| 3 | A | 680 | 5 | 26 | 53 | 26 | 780 | 10 | 0.04 | 18 |
| 4 | A | 800 | 6 | 26 | 50 | 21 | 750 | 15 | 0.10 | 20 |
| 5 | A | 590 | 12 | 21 | 51 | 21 | 820 | 20 | 0.25 | 19 |
| 6 | A | 620 | 6 | 15 | 60 | 21 | 760 | 10 | 0.10 | 25 |
| 7 | A | 560 | 6 | 20 | 45 | 26 | 780 | 8 | 0.36 | 18 |
| 8 | A | 680 | 7 | 23 | 53 | 48 | 830 | 20 | 0.08 | 20 |
| 9 | B | 700 | 6 | 26 | 59 | 20 | 750 | 30 | 0.15 | 25 |
| 10 | B | 710 | 7 | 28 | 56 | 21 | 800 | 10 | 0.20 | 19 |
| 11 | B | 630 | 5 | 29 | 57 | 26 | 750 | 32 | 0.12 | 19 |
| 12 | B | 650 | 9 | 27 | 52 | 28 | 890 | 16 | 0.01 | 20 |
| 13 | B | 620 | 8 | 27 | 54 | 24 | 740 | 3 | 0.10 | 16 |
| 14 | B | 680 | 8 | 26 | 58 | 27 | 750 | 10 | 0.70 | 18 |
| 15 | B | 710 | 7 | 24 | 51 | 26 | 760 | 15 | 0.20 | 8 |
| 16 | C | 730 | 5 | 25 | 52 | 28 | 800 | 16 | 0.13 | 15 |
| 17 | C | 590 | 6 | 29 | 59 | 29 | 650 | 24 | 0.25 | 16 |
| 18 | C | 560 | 9 | 28 | 58 | 30 | 680 | 10 | 0.06 | 18 |
| 19 | C | 600 | 9 | 27 | 53 | 35 | 720 | 30 | 0.03 | 18 |
| 20 | D | 640 | 8 | 23 | 52 | 36 | 750 | 21 | 0.10 | 15 |
| 21 | D | 520 | 5 | 26 | 56 | 21 | 810 | 10 | 0.20 | 16 |
| 22 | E | 680 | 6 | 21 | 59 | 25 | 820 | 15 | 0.09 | 18 |
| 23 | E | 665 | 8 | 21 | 54 | 38 | 820 | 8 | 0.65 | 20 |
| 24 | F | 620 | 6 | 25 | 57 | 21 | 810 | 7 | 0.15 | 18 |
| 25 | F | 640 | 6 | 26 | 52 | 24 | 830 | 16 | 0.18 | 5 |
| 26 | G | 680 | 7 | 24 | 55 | 25 | 850 | 8 | 0.20 | 16 |
| 27 | H | 720 | 7 | 22 | 51 | 26 | 790 | 5 | 0.30 | 19 |

TABLE 2-continued

| | | | | | | | | | | |
|---|---|---|---|---|---|---|---|---|---|---|
| 28 | I | 715 | 6 | 23 | 56 | 28 | 780 | 10 | 0.25 | 20 |
| 29 | J | 720 | 8 | 26 | 59 | 27 | 790 | 15 | 0.01 | 21 |
| 30 | K | 580 | 8 | 29 | 56 | 23 | 810 | 7 | 0.06 | 16 |
| 31 | L | 650 | 6 | 24 | 57 | 21 | 820 | 10 | 0.12 | 17 |
| 32 | M | 645 | 7 | 23 | 54 | 21 | 830 | 12 | 0.09 | 19 |
| 33 | N | 620 | 9 | 26 | 51 | 21 | 810 | 6 | 0.30 | 18 |
| 34 | O | 670 | 9 | 24 | 52 | 23 | 800 | 18 | 0.14 | 19 |
| 35 | P | 650 | 6 | 28 | 54 | 35 | 770 | 10 | 0.02 | 20 |
| 36 | Q | 720 | 6 | 23 | 59 | 32 | 690 | 10 | 0.05 | 18 |
| 37 | R | 710 | 5 | 26 | 53 | 21 | 760 | 10 | 0.23 | 17 |
| 38 | S | 580 | 6 | 24 | 52 | 21 | 780 | 5 | 0.06 | 21 |
| 39 | T | 620 | 7 | 29 | 55 | 25 | 820 | 6 | 0.18 | 19 |
| 40 | U | 630 | 6 | 20 | 55 | 26 | 810 | 10 | 0.18 | 20 |
| 41 | V | 680 | 5 | 21 | 56 | 24 | 820 | 10 | 0.19 | 18 |
| 42 | W | 650 | 8 | 26 | 54 | 21 | 790 | 10 | 0.18 | 17 |

| Steel sheet No. | Coating Alloying temperature/° C. | Analysis Fe/mass % | Analysis $SiC/SiO_2$ | Analysis Retained γ/vol % | Appearance | Adhesion | Remarks |
|---|---|---|---|---|---|---|---|
| 1 | 555 | 10.2 | 0.52 | 2.3 | ○ | ○ | Example |
| 2 | 555 | 9.5 | 0.34 | 6.5 | ○ | ⊙ | Example |
| 3 | 555 | 10.6 | 0.41 | 1.5 | ○ | ○ | Example |
| 4 | 550 | 13.5 | 0.32 | 0.8 | Δ | Δ | Comparative example |
| 5 | 545 | 7.5 | 0.16 | 6.3 | ▲ | ○ | Comparative example |
| 6 | 550 | 6.8 | 0.12 | 5.1 | X | ⊙ | Comparative example |
| 7 | 550 | 7.1 | 0.08 | 1.5 | X | ⊙ | Comparative example |
| 8 | 555 | 13.8 | 0.31 | 3.1 | ○ | X | Comparative example |
| 9 | 555 | 11.0 | 0.26 | 7.6 | ○ | ○ | Example |
| 10 | 560 | 11.1 | 0.24 | 2.1 | ○ | ○ | Example |
| 11 | 550 | 9.8 | 0.35 | 1.6 | ○ | ○ | Example |
| 12 | 560 | 7.1 | 0.05 | 1.7 | ▲ | ⊙ | Comparative example |
| 13 | 555 | 6.5 | 0.15 | 3.2 | X | ⊙ | Comparative example |
| 14 | 550 | 14.1 | 0.09 | 3.6 | ○ | X | Comparative example |
| 15 | 560 | 7.0 | 0.18 | 0.1 | X | ⊙ | Comparative example |
| 16 | 550 | 8.8 | 0.26 | 1.6 | ○ | ⊙ | Example |
| 17 | 545 | 9.2 | 0.29 | 6.0 | ○ | ⊙ | Example |
| 18 | 580 | 13.6 | 0.34 | 4.9 | ○ | X | Comparative example |
| 19 | 575 | 14.2 | 0.26 | 8.1 | Δ | X | Comparative example |
| 20 | 560 | 10.7 | 0.21 | 3.0 | ○ | ○ | Example |
| 21 | 545 | 7.0 | 0.13 | 3.5 | ▲ | ⊙ | Comparative example |
| 22 | 560 | 10.2 | 0.26 | 7.6 | ○ | ○ | Example |
| 23 | 560 | 13.9 | 0.12 | 3.1 | ○ | X | Comparative example |
| 24 | 555 | 9.7 | 0.27 | 1.7 | ○ | ○ | Example |
| 25 | 550 | 6.9 | 0.16 | 0.1 | X | ⊙ | Comparative example |
| 26 | 560 | 9.5 | 0.29 | 3.1 | ○ | ⊙ | Example |
| 27 | 585 | 14.3 | 0.12 | 6.4 | ○ | X | Comparative example |
| 28 | 560 | 10.1 | 0.26 | 0.9 | ○ | ○ | Example |
| 29 | 550 | 10.6 | 0.24 | 0.7 | ○ | ○ | Example |
| 30 | 555 | 13.5 | 0.21 | 1.5 | ○ | Δ | Comparative example |
| 31 | 555 | 14.6 | 0.30 | 1.9 | Δ | X | Comparative example |
| 32 | 540 | 6.3 | 0.13 | 2.8 | ▲ | ⊙ | Comparative example |
| 33 | 540 | 7.8 | 0.18 | 3.4 | X | ○ | Comparative example |
| 34 | 560 | 6.5 | 0.06 | 1.9 | X | ⊙ | Comparative example |
| 35 | 560 | 6.9 | 0.09 | 7.1 | X | ⊙ | Comparative example |
| 36 | 555 | 7.4 | 0.16 | 5.2 | ▲ | ○ | Comparative example |
| 37 | 550 | 6.9 | 0.19 | 3.1 | X | ⊙ | Comparative example |
| 38 | 550 | 5.6 | 0.17 | 2.0 | X | ⊙ | Comparative example |
| 39 | 560 | 5.8 | 0.14 | 1.9 | ▲ | ⊙ | Comparative example |
| 40 | 545 | 13.5 | 0.26 | 1.4 | Δ | Δ | Comparative example |
| 41 | 560 | 14.6 | 0.23 | 2.3 | ○ | X | Comparative example |
| 42 | 550 | 5.7 | 0.14 | 2.7 | X | ⊙ | Comparative example |

Table 2 shows that the galvannealed steel sheet of each example had good surface appearance and adhesion to the coating.

Because of good coating appearance and adhesion to coating, galvannealed steel sheets according to the present invention are expected to find a wide range of uses particularly in the fields of automobiles, household electrical appliances, and construction materials.

The invention claimed is:

1. A galvannealed steel sheet having a galvanized layer on a surface thereof, said steel sheet having a composition comprising on a mass basis: C: 0.10% to 0.35%, Si: 0.3% to 3.0%, Mn: 0.5% to 3.0%, P: 0.001% to 0.10%, Al: 0.01% to 3.00%, and S: 0.200% or less, a remainder being Fe and incidental impurities, wherein the steel sheet has a $SiC/SiO_2$ ratio of more than 0.20, the $SiC/SiO_2$ ratio being a ratio of SiC amount to $SiO_2$ amount at a depth of 1 μm or less in the steel sheet from an interface between the steel sheet and the galvanized layer, and Fe in the galvanized layer constitutes 8% to 13% by mass.

2. The galvannealed steel sheet according to claim 1, wherein a retained austenite phase constitutes 0.2% or more by area of the steel sheet at a depth of 1 μm or less in the steel sheet from the interface between the steel sheet and the galvanized layer.

3. The galvannealed steel sheet according to claim 1, the composition further comprising one or two selected from Mo: 0.01% to 1.00% and Cr: 0.01% to 1.00% on a mass basis.

4. The galvannealed steel sheet according to claim 1, the composition further comprising one or two or more selected from Nb: 0.005% to 0.20%, Ti: 0.005% to 0.20%, Cu: 0.01% to 0.50%, Ni: 0.01% to 1.00%, and B: 0.0005% to 0.010% on a mass basis.

5. A method for producing a galvannealed steel sheet, comprising:

hot rolling and then cold rolling a steel having the composition according to claim 1;

then heating the steel in a direct heating furnace equipped with a direct fired burner to a final surface temperature in the range of 550° C. to 750° C. by burning a combustible gas and a combustion-supporting gas, the combustible gas having a CO concentration in the range of 5% to 10% by volume, a $CH_4$ concentration in the range of 20% to 30% by volume, and a $H_2$ concentration in the range of 50% to 60% by volume, a remainder of the combustible gas being $N_2$ and incidental impurities, the combustion-supporting gas having an $O_2$ concentration in the range of 20% to 40% by volume, a remainder of the combustion-supporting gas being $N_2$ and incidental impurities;

then heating the steel at a soaking temperature in the range of 630° C. to 850° C. in an atmosphere having a $H_2$ concentration in the range of 5% to 40% by volume and a $H_2O$ concentration in the range of 0.01% to 0.40% by volume, a remainder of the atmosphere being $N_2$ and incidental impurities; and cooling the steel at an average cooling rate of 15° C./s or more, then subjecting the steel to hot-dip galvanizing treatment, and subjecting the steel to alloying treatment at a temperature of 560° C. or less.

* * * * *